US007833404B2

(12) United States Patent
Matsuda et al.

(10) Patent No.: US 7,833,404 B2
(45) Date of Patent: Nov. 16, 2010

(54) ELECTROLYTIC PHOSPHATE CHEMICAL TREATMENT METHOD

(75) Inventors: Shigeki Matsuda, Okazaki (JP); Shin Nishiya, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/077,777

(22) Filed: Feb. 20, 2002

(65) Prior Publication Data

US 2002/0162752 A1 Nov. 7, 2002

(30) Foreign Application Priority Data

Feb. 23, 2001 (JP) ..... 2001-049017
Jan. 29, 2002 (JP) ..... 2002-020568

(51) Int. Cl.
*C25D 3/56* (2006.01)
*C25D 21/06* (2006.01)
*C25D 21/18* (2006.01)

(52) U.S. Cl. ..... 205/238; 205/98; 205/101; 205/258

(58) Field of Classification Search ..... 205/238, 205/258, 98, 101, 318; 148/240
See application file for complete search history.

(56) References Cited

U.S. PATENT DOCUMENTS 4,565,585 A * 1/1986 Matsuda ..... 148/241
5,645,706 A * 7/1997 Matsuda ..... 205/82
6,984,300 B2 * 1/2006 Nishiya et al. ..... 205/101

FOREIGN PATENT DOCUMENTS

| | | | |
|---|---|---|---|
| EP | 0 597 131 | A1 | 5/1994 |
| EP | 597131 | A1 * | 5/1994 |
| EP | 1 074 640 | A1 | 2/2001 |
| EP | 1074640 | A1 * | 2/2001 |
| JP | A 2000-234200 | | 8/2000 |

* cited by examiner

*Primary Examiner*—Edna Wong
(74) *Attorney, Agent, or Firm*—Oliff & Berridge, PLC

(57) ABSTRACT

A method of forming a film composed of a phosphate compound and a metal on the surface of an article to be treated by performing electrolytic treatment on a metal article to be treated in a phosphate chemical treatment bath. The method includes contacting the metal article having electrical conductivity with the phosphate chemical treatment bath containing phosphate ions and phosphoric acid, nitrate ions, metal ions that form a complex with phosphate ions in the phosphate chemical treatment bath, and metal ions for which the dissolution-precipitation equilibrium potential at which ions dissolved in the phosphate chemical treatment bath are reduced and precipitate as metal is equal to or greater than −830 mV. The (oxidation-reduction potential) of the phosphate chemical treatment bath is maintained at equal to or greater than 700 mV.

13 Claims, 4 Drawing Sheets

ELECTROLYTIC PHOSPHATE CHEMICAL TREATMENT METHOD

BACKGROUND OF THE INVENTION

1. Field of the Invention

The present invention relates to surface treatment of a metal, and more particularly, to surface treatment of a metal using a phosphate chemical film.

2. Description of the Related Art

To begin with, if phosphate chemical treatment technology were to be divided into electrolytic treatment and non-electrolytic treatment, electrolytic treatment would be a new technology while non-electrolytic treatment would be a conventional technology. Although the reaction of phosphate chemical treatment is an electrochemical reaction for both non-electrolytic treatment and electrolytic treatment, the contents of that reaction are quite different.

The inventor of the present invention previously filed a patent relating to electrolytic phosphate chemical treatment (Japanese Unexamined Patent Publication No. 2000-234200). At the time of the previous filing, a study was conducted relating to electrolytic phosphate chemical treatment of the prior art. However, studies regarding the inherent prior art of non-electrolytic phosphate chemical treatment were not always adequate. To begin with, the difference between the electrochemical reactions of non-electrolytic treatment and electrolytic treatment are clarified with respect to surface treatment. To accomplish this object, the mechanism of the chemical reaction in non-electrolytic treatment is shown in FIG. 8. In contrast, the mechanism of the electrochemical reaction in electrolytic treatment is shown in FIG. 1.

The major differences between non-electrolytic treatment and electrolytic treatment with respect to surface treatment can be summarized as indicated below.

(i) In the case of non-electrolytic treatment, a film is formed by an electrochemical reaction in the same treatment bath and on the same metal surface. Namely, the anode and cathode in the electrochemical reaction are the same metal surfaces. On the other hand, electrolytic treatment involves the application of voltage and current from an external power supply in the same treatment bath. A film is then formed by an electrochemical reaction under conditions in which the electrodes are divided into an anode and cathode. Consequently, the electrochemical reaction in electrolytic treatment is divided into a reaction on an anode and a reaction on a cathode that are separated in a treatment bath.

(ii) In electrolytic treatment, as shown in FIG. 1, a solution is divided into a solution phase and an interface (metal surface). It is necessary that the applied voltage and current be limited to acting only on the interface. As a result, the film forming reaction of the solution component due to electrolysis only acts on the metal surface. In this manner, the phase transition (film formation) from the liquid to solid, which constitutes the deposition of the film, can be limited to only the metal surface. In other words, in electrolytic treatment, it is important to create a mechanism that is capable of preventing a reaction in the solution phase.

On the other hand, in non-electrolytic treatment, although film formation occurs on the surface of an article to be treated, the reaction components are supplied to a location away from the metal surface (solution phase). Namely, in non-electrolytic treatment, a film is formed on the metal surface by allowing the component of the solution phase to react. This is because film formation (phase transition from a liquid to a solid) is carried out more easily on the surface of the article to be treated (metal) than in the solution phase. Consequently, it is not necessary in non-electrolytic treatment to strictly separate the solution phase and interface as compared with electrolytic treatment. From the standpoint of forming a film by controlling an electrochemical reaction, there is a considerable difference between forming sludge by reacting the component of a solution phase and not forming sludge by not allowing to react.

(iii) Difference in Reaction Voltage

The present invention is targeted at film formation from an aqueous solution using water as the solvent. The electrochemical reaction in non-electrolytic treatment does not assume the decomposition of a solvent in the form of water. Consequently, the electrochemical reaction is at a voltage of 1.23 V or less, the decomposition voltage of water. On the other hand, in the case of electrolytic treatment, which uses an external power supply, it is typically accompanied by a decomposition reaction of water (solvent). Consequently, the electrolytic reaction voltage typically exceeds 1.23 V. This difference in the reaction voltage, along with the presence or absence of the accompanying decomposition of solvent (water), are the major differences between electrolytic treatment and non-electrolytic treatment.

Next, an explanation is provided of the prior art with respect to electrolytic treatment.

As an example of the prior art, Japanese Unexamined Patent Publication No. 2000-234200 discloses an electrolytic phosphate treatment method comprising:

forming a film containing a phosphate compound and a metal that is not a phosphate on the surface of an article to be treated having electrical conductivity by performing electrolytic treatment by contacting the article to be treated with a phosphate chemical treatment bath containing phosphate ions and phosphoric acid, nitrate ions, metal ions that form a complex with the phosphate ions in the phosphate chemical treatment bath (e.g., zinc, iron, manganese or calcium ions), and metal ions for which the electrical potential at which the ions dissolved in the phosphate chemical treatment bath are reduced and precipitate as metal is equal to or greater than the cathodic electrolysis reaction potential of the solvent in the form of water or equal to or greater than −830 mV (e.g., nickel, copper or iron ion) based on a reference electrode potential; wherein the above phosphate chemical treatment bath contains 0-400 ppm of metal ions other those which are a component that forms the above film (e.g., sodium ion), and is substantially free of solids (sludge) having an effect on the film formation reaction; and the above article to be treated is treated by electrolysis in the above phosphate chemical treatment bath with a metal material that forms a complex with phosphate ions in this treatment bath, and a metal material for which the electrical potential at which ions thereof dissolved in the phosphate chemical treatment bath are reduced and precipitate as metal is, based on a reference electrode potential, equal to or greater than the cathodic electrolysis reaction potential of the solvent in the form of water or −830 mV or higher (indicated as the potential relative to a standard hydrogen electrode), and/or an insoluble electrode material.

This electrolytic phosphate treatment method of the prior art was developed in order to efficiently form a phosphate-metal mixed chemical film without causing the formation of sludge in the treatment bath. However, when this method is used to carry out treatment continuously, it was found that sludge forms depending on the treatment conditions.

One of the reasons for being unable to practically apply the electrolytic phosphate chemical treatment in Japanese Unexamined Patent Publication No. 2000-234200 is that in phosphate chemical treatment, all three constituent features relating to electrolytic treatment consisting of the solution, counter electrode and article to be treated are involved in the reaction. The following Table 1 is shown in reference to this point.

TABLE 1

Classification of Wet Electrolytic Treatment
(O: Reacts, X: Does not react)

| | Counter electrode | Solution | Article to be treated |
|---|---|---|---|
| Electroplating | O | X | X |
| Electrodeposition coating | X | O | X |
| Electrolytic phosphate chemical treatment | O or X | O | O |

In the electrolytic phosphate chemical treatment of the above-mentioned Japanese Unexamined Patent Publication No. 2000-234200, attention was not paid to "not allowing the components in solution to react at a location other than the electrode surface" in particular. Consequently, corrective actions and accommodations were performed consisting of:

(1) prevention of contamination by impurities (Na ions, etc.)

(2) prevention of self-decomposition and aggregation of solution components by constantly filtering and circulating the treatment, maintaining the temperature and so forth, and (3) use of a complex.

However, in the case of performing treatment continuously, it was found to be difficult to maintain "not allowing the components in solution to react at a location other than the electrode surface" with only the accommodations made in the above-mentioned invention of Japanese Unexamined Patent Publication No. 2000-234200. Namely, in Japanese Unexamined Patent Publication No. 2000-234200, although the treatment bath is constantly filtered and circulated during electrolytic treatment, it was found that solids (sludge) are trapped by the filter at that time. The amount captured can be maintained within a range that can be allowed with respect to film formation in terms of practical application of this method. However, this sludge becomes partially redissolved (for example, $Zn_2Fe(PO_4)_2+6H^+ \rightarrow 2H_3PO_4+2Zn^{2+}+Fe^{2+}$). This phenomenon (reaction) impairs film formation. Thus, it is thought to be necessary to devise even more effective countermeasures in order to stabilize the electrolytic phosphate chemical treatment bath and prevent the formation of a waste product in the form of sludge.

As has been described above, the prior art relating to electrolytic phosphate chemical treatment was inadequate with respect to not allowing the reaction of solution phase components (not allowing the formation of sludge), which is the basis of electrolytic surface treatment technology. For this reason, the electrolytic phosphate chemical treatment technology of the prior art was inadequate as an electrolytic surface treatment technology.

SUMMARY OF THE INVENTION

The object to be solved by the present invention is to assemble an electrolytic phosphate chemical treatment technology in the form of a technology that is in accordance with the general principle of electrolytic surface treatment. That is, to limit the electrolytic phosphate chemical treatment reaction to only a reaction of a metal (electrode) surface, and not a liquid phase reaction.

Although the inventor of the present invention devised a countermeasure for preventing an electrolytic reaction in the solution phase in an invention disclosed in previously disclosed Japanese Unexamined Patent Publication No. 2000-234200, this could not always be said to be adequate with respect to reliably preventing the solution phase reaction and limiting to only a reaction of a metal surface. Therefore, the problem to be solved by the present invention is to improve the level of control of an electrolytic phosphate chemical treatment reaction as an electrolytic surface treatment in the invention disclosed in Japanese Unexamined Patent Publication No. 2000-234200. Namely, the object of the present invention is to establish a means for further improving the reaction efficiency on a metal surface (interface) by preventing the reaction in the solution phase to reliably prevent sludge formation during continuous treatment.

According to a first mode of the present invention, the present invention is an electrolytic phosphate chemical treatment method of forming a film composed of a phosphate compound and a metal that is reduced and precipitated from an ionic state on the surface of a metal material article to be treated by performing electrolytic treatment on said article to be treated in a phosphate chemical treatment bath by contacting said metal material having electrical conductivity with said phosphate chemical treatment bath containing phosphate ions and phosphoric acid, nitrate ions, metal ions that form a complex with phosphate ions in said phosphate chemical treatment bath, and metal ions for which the dissolution-precipitation equilibrium potential at which ions dissolved in said phosphate chemical treatment bath are reduced and precipitate as metal is equal to or greater than −830 mV, which is the cathodic reaction decomposition potential of the solvent in the form of water when indicated as the hydrogen standard electrode potential, and is substantially free of metal ions other than those which are a component of the film; wherein, the ORP (oxidation-reduction potential) of said phosphate chemical treatment bath (indicated as the potential relative to a standard hydrogen electrode) is maintained at equal to or greater than 700 mV.

The above "substantially free of metal ions other than those which are a component of the film" means that the content of metal ions other than those which are a component of the film is either zero or 0.5 g/L or less.

In this manner, by making the ORP equal to or greater than 700 mV, the sludge formation of the electrolytic treatment bath of the present invention can be made to be substantially zero.

According to a second mode of the present invention, the above electrolytic treatment preferably uses for the electrode material that dissolves in the treatment bath a metal that forms a complex with phosphoric acid and phosphate ions in the phosphate chemical treatment bath and/or a metal material for which the dissolution-precipitation equilibrium potential at which ions dissolved in the phosphate chemical treatment bath are reduced and precipitate as metal is greater than or equal to −830 mv, which is the cathodic reaction decomposition potential of the solvent in the form of water when indicated as the hydrogen standard electrode potential, and a metal material that is insoluble during electrolysis.

According to a third mode of the present invention, it is preferable to control the amount of Fe ions dissolved into the treatment bath from an Fe electrode in the case of using an Fe electrode as the electrode that dissolves in the treatment bath during cathodic treatment of the above article to be treated in order to make the above ORP of the phosphate chemical treatment bath equal to or greater than 700 mV.

Moreover, according to a fourth mode of the present invention, it is preferable to control the amount of Fe ions dissolved into the treatment bath in anodic treatment in which the article to be treated is a steel material and the steel material in the form of the article to be treated is dissolved as the anode, and the amount of Fe ions that dissolve in the treatment bath in the case of using an Fe electrode in cathodic treatment, so that the above ORP of the phosphate chemical treatment bath is equal to or greater than 700 mV.

In addition, according to a fifth mode of the present invention, it is preferable that a chemical that contains Fe ions which replenish the above phosphate chemical treatment bath be a Fe-phosphate complex in order to make the above ORP of the phosphate chemical treatment bath equal to or greater than 700 mV.

According to a sixth mode of the present invention, the above ORP of the phosphate chemical treatment bath is preferably equal to or greater than 770 mV.

Moreover, according to a seventh mode of the present invention, metal ions that form a complex with phosphoric acid and phosphate ions in the phosphate chemical treatment bath are preferably at least one type of Zn, Fe, Mn or Ca ions.

In addition, according to an eighth mode of the present invention, an electrolytic phosphate chemical treatment method is preferable which removes gases generated and dissolved in an electrolytic treatment tank in the form of NO, $NO_2$ and/or $N_2O_4$ from the bath by separating the treatment tank into an electrolytic treatment tank that carries out electrolytic treatment and an auxiliary tank that does not carry out electrolytic treatment, circulating the treatment bath between the two tanks, and providing a mechanism that opens treatment liquid to the atmosphere either between the above two tanks or within the two tanks, as a means of separating $NO_2$, $N_2O_4$ and/or NO gas formed in the treatment bath accompanying electrolytic treatment from the treatment bath.

According to a ninth mode of the present invention, the above auxiliary tank that does not carry out electrolytic treatment has a mechanism in which treatment liquid is passed through a permeable solid structure such as a film, and a filter having a filtering mechanism is preferably used for such an auxiliary tank.

Moreover, according to a tenth mode of the present invention, a liquid circulation circuit is preferably provided that removes a portion of the treatment liquid at a location prior to being introduced into the filter material in the filter, exposes the removed treatment liquid to the atmosphere, and returns it to the electrolysis tank after removing gases in the form of nitrogen oxides present in the treatment liquid.

According to an eleventh mode of the present invention, the above ORP of the treatment bath is preferably equal to or greater than 840 mV.

Moreover, according to a twelfth mode of the present invention, it is preferable to maintain the above treatment bath in a constant state by measuring the above ORP value of the treatment bath and changing the amount and/or composition of replenishing chemical corresponding to the change in that value.

DESCRIPTION OF THE PREFERRED EMBODIMENTS

Figure 1:
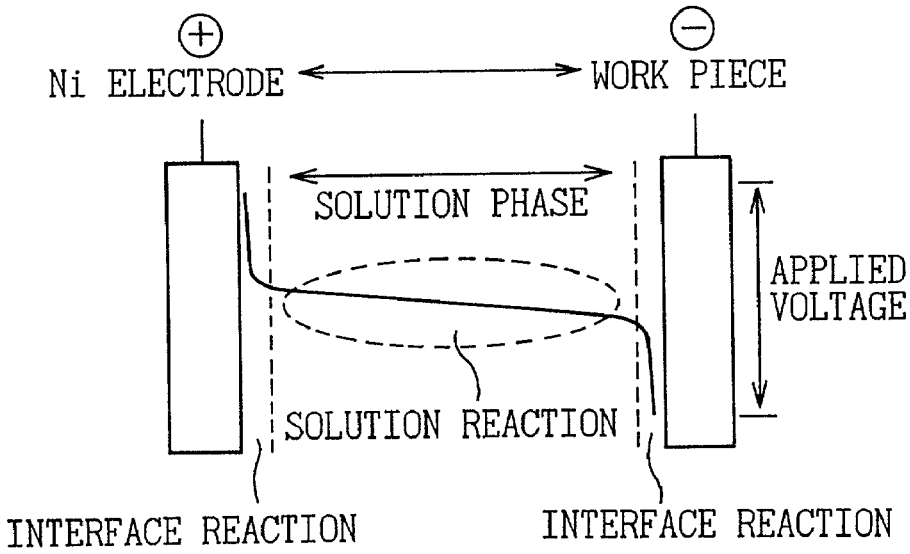
FIG. 1 is a drawing showing the mechanism of the electrochemical reactions in electrolytic treatment.
Figure 2:
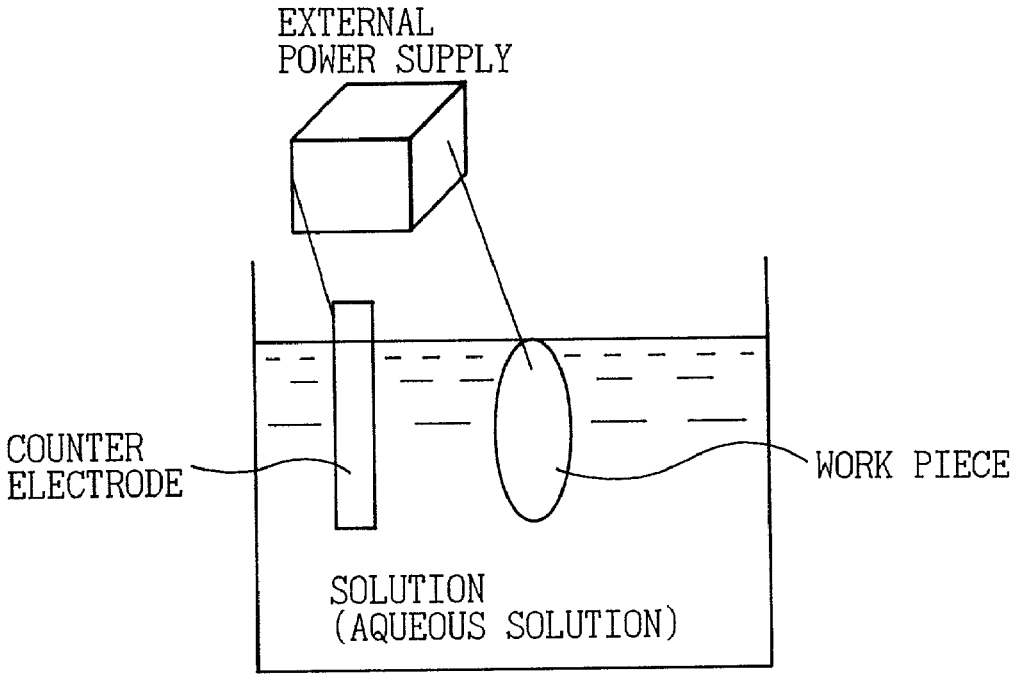
FIG. 2 is a drawing showing the constituent features of electrolytic treatment used in the examples and comparative examples.

The potential difference distribution of an electrolytic reaction relating to surface treatment using an external power supply is as shown in FIG. 1 between two electrodes (namely an anode and cathode (working electrode)). In FIG. 1, when a voltage is applied between the two electrodes, the voltage distribution is divided into two parts as shown in this drawing. Namely, the voltage between the two electrodes is divided into a potential difference at the electrode interface and a potential difference in the solution phase.

Film formation in electrolytic treatment is carried out by causing the components dissolved in the solution to undergo an electrochemical reaction (oxidation reaction or reduction reaction) on the electrode (solid) surface due to this change in potential difference at the electrode interface. Namely, a film is formed by a reaction (interface reaction) at the electrode surface (interface).

On the other hand, the change in the potential difference in the solution phase occurs as a result of a chemical reaction accompanying a change in the potential difference at the electrode interface, and is a reflection of the electrochemical equilibrium between chemical component ions in the solution phase. Namely, changes in potential difference in the solution phase do not reflect a chemical reaction resulting from electrolysis of solution phase components. Consequently, it is essential that changes in the potential difference in the solution phase be of an extremely low voltage and do not cause a phase transition (solution→solid) accompanying chemical reaction. Namely, in electrolytic surface treatment, it is necessary that the electrolytic treatment reaction not be allowed occur in the solution phase.

On the basis of the above, in electrolytic surface treatment pertaining to film formation, a solution phase reaction is a detrimental reaction. In electrolytic phosphate chemical treatment, sludge forms if a solution phase reaction occurs. Electrolytic surface treatment that is already used practically (electroplating, electrodeposition coating) employs contrivances such that only the interface reaction is allowed to occur while the solution phase reaction is not. Namely, actions are taken so that all of the electrical energy (voltage, current) applied to the electrolytic treatment system acts only on the electrode interface.

The object of the present invention is to improve the efficiency of the electrolytic phosphate chemical treatment reaction. The means for achieving this is basically similar to other electrolytic surface treatment, consisting of preventing a reaction in the solution phase (solution phase reaction) and improving the efficiency of the reaction (interface reaction) at the electrode surface (interface). However, a means that is unique to electrolytic phosphate chemical treatment is required for the specific means for achieving this.

Namely, a first means is preventing the reaction in the solution phase (solution phase reaction).

In the case of electroplating, which is an electrolytic surface treatment that is already used practically, metal ions that have dissolved from the anode are present in solution as a complex, and are stable in the solution. The reasons for using a cyanide-complex for the electroplating bath is that cyanide complex can be used that is stable in the solution phase with respect to application of voltage. As a result, voltage applied between the electrodes does not act in the solution phase. The change in potential difference of the applied voltage only acts at the electrode surface, while the metal to be plated dissolves at the anode and precipitates at the cathode.

In cationic electrodeposition coating, which is another electrolytic surface treatment that is used practically, the solute component is an organic substance, and a complex cannot be used in the manner of electroplating. Consequently, accommodations must be made using a different method.

The electrodeposition coating liquid is a solution in which an organic substance is dispersed. Moreover, the anode in cationic electrodeposition coating is insoluble. In the case of electrodeposition coating, preventing the solution phase reaction means maintaining the coating liquid in a state in which organic substances are dispersed. If the coating liquid is unable to be maintained in a state in which organic substances are dispersed, the coating liquid aggregates resulting in the formation of solids. Namely, the solution phase reaction proceeds.

Actions are taken for electrodeposition coating so that a solution state can be maintained at all times. More specifically, these actions consist of controlling the temperature at a constant temperature, preventing contamination by Na ions and other impurities, and constantly filtering and circulating the coating liquid to prevent the decomposition and separation of organic substances of the solution components, including solids. Since these actions are taken, electrodeposition coating is able to maintain a solution state at all times and prevent reactions in the solution phase. When a voltage is applied between electrodes of an electrolysis liquid controlled in this manner, that voltage does not act in the solution phase. Changes in the potential difference of the applied voltage act only at the electrode surface, and an electrodeposition coating film precipitates on the surface of the cathode (working surface).

Namely, in practical electrolytic treatment that forms a film, means for preventing a reaction in the solution phase of the above FIG. 1 are determined and strictly observed.

In the electrolytic phosphate chemical treatment of the prior art, the above approach of preventing reaction in the solution phase was not given adequate consideration at the practical level. Those accommodations are made in the present invention.

Next, a second means of improving electrolytic phosphate chemical treatment reaction efficiency consists of improving the reaction efficiency at the electrode surface (interface).

Although electrolytic phosphate treatment involves electrolytic surface treatment using water for the solvent, the following clarifies differences with other electrolytic treatment (such as electroplating and electrodeposition coating) that similarly use water for the solvent.

In electrolytic phosphate chemical treatment (cathodic treatment), the gas that is generated from the treatment bath differs from conventional electrolytic treatment (e.g., electroplating and electrodeposition coating). This is illustrated in Table 2.

TABLE 2

Electrolytic Treatment and Reaction Components

| | Solvent (water) | | Solute | |
|---|---|---|---|---|
| | Hydrogen gas ($H_2$) | Oxygen gas ($O_2$) | Film components | Non-film components |
| Electroplating | O (formed) | O (formed) | O (formed) | X (not formed) |
| Electrodeposition coating | O (formed) | O (formed) | O (formed) | X (not formed) |
| Electrolytic phosphate chemical treatment | O (formed) | O (formed) | O (formed) | O (formed: nitrogen oxides) |

In the case of conventional electrolytic treatment using water for the solvent, the gas that is generated from the treatment bath is only hydrogen gas and oxygen gas resulting from electrolysis of water. However, in the case of electrolytic phosphate chemical treatment, in addition to hydrogen and oxygen, there are also nitrogen oxides generated by decomposition of $NO_3^-$, a solute component. As shown in Table 3, the states of these nitrogen oxides consist of NO, $NO_2$ and $N_2O_4$, and their boiling points at atmospheric pressure differ considerably.

TABLE 3

Differences in Boiling Points at Atmospheric Pressure

| | |
|---|---|
| NO: −151° C. | |
| $NO_2$: 21.15° C. | $H_2$: −252° C. |
| $N_2O_4$: 29.07° C. | $O_2$: −182° C. |

Thus, if the state of the nitrogen oxides generated is controlled, the reaction state in the treatment bath is presumed to change considerably. This was not examined at all in Japanese Unexamined Patent Publication No. 2000-234200.

Table 3 shows a comparison of the boiling points of each gas at atmospheric pressure. In the case of conventional electrolytic surface treatment (electroplating and electrodeposition coating), the gas generated in the electrolysis reaction consists only of hydrogen gas and oxygen gas as a result of electrolysis of the solvent in the form of water as shown in Table 2. The boiling points of hydrogen and oxygen are extremely low as shown in Table 3. This indicates that both hydrogen and oxygen are easily evaporated and removed from the treatment bath.

However, the gases generated in electrolytic phosphate chemical treatment consist of nitrogen oxide gas ($N_2O_4$, $NO_2$ and NO) in addition to hydrogen gas and oxygen gas as shown in Table 2. It is clear that the ease by which this gas is removed from the treatment bath differs depending on the state of this nitrogen oxide gas ($N_2O_4$, $NO_2$ and NO). Namely, whether the nitrogen oxide gas generated is in the form of $N_2O_4$ and $NO_2$ or NO results in a considerable difference in the conditions by which the gas is removed from the treatment bath. If the gas that is generated can be limited only to NO, the reaction (interface reaction) at the electrode surface (interface) is thought to be able to be maintained at the level of electroplating. However, if the gas that is generated contains $N_2O_4$ and $NO_2$, that gas cannot be easily removed from the treatment bath, and it is therefore presumed that the reaction efficiency at the electrode surface (interface) would decrease.

A decrease in the reaction efficiency at the electrode surface (interface) is presumed to cause a decrease in adherence between the film and article to be treated. Thus, limiting the gas generated to NO only is required for electrolytic phosphate chemical treatment, and the present invention provides a specific method for accomplishing this.

Elementary Reaction of Electrolytic Phosphate Chemical Treatment Reaction and Prevention of Solution Phase Reaction Possible elementary reactions that may take place in electrolytic phosphate chemical treatment are shown in Tables 4 and 5.

The following provides an explanation of specific measures for preventing the solution phase reaction.

Figure 8:
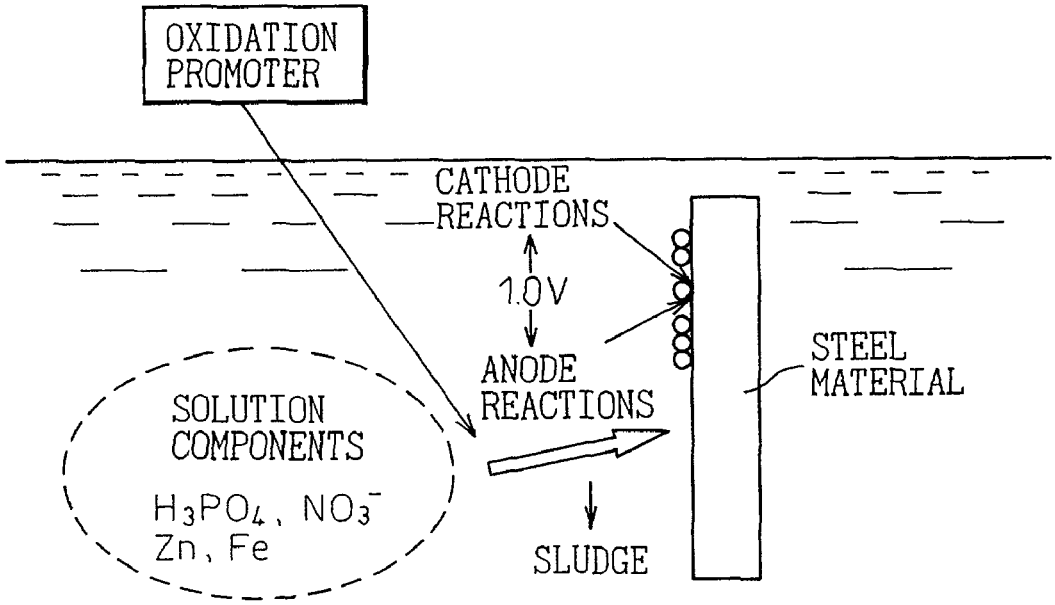
FIG. 8 is a drawing showing the mechanism of the electrochemical reactions in non-electrolytic treatment.

As shown in FIG. 1, the solution phase reaction is not affected by the application of voltage and current by an external power supply in the case of fundamental electrolytic surface treatment. This should also be observed in electrolytic phosphate chemical treatment as well. However, conventional non-electrolytic phosphate chemical treatment forms a film by using a solution phase reaction (see FIG. 8).

Electrochemical equilibrium reactions that have the possibility of occurring in the solution phase of an electrolytic phosphate chemical treatment bath are shown in Table 4.

TABLE 4

| Electrochemical Equilibrium Reactions that can Occur in the Solution Phase | |
|---|---|
| Dissociation of phosphoric acid | $H_3PO_4 \rightarrow H^+ + H_2PO_4^-$ (1)<br>$H_2PO_4^- \rightarrow 2H^+ + PO_4^{3-}$ (2) |
| $Fe^{2+}/Fe^{3+}$ | $Fe^{2+} \rightarrow Fe^{3+} + e^-$ (0.77 V) (3) |

The reactions of (1) through (3) in Table 4 are essential reactions in non-electrolytic treatment, and they take place in the solution phase in non-electrolytic treatment.

The reactions of (1) through (3) are reactions that occur in non-electrolytic treatment. This means that the reactions of (1) through (3) occur due to factors other than the application of voltage and current to the treatment bath. Namely, they occur due to changes in the electrochemical conditions (pH, ORP, etc.) of the treatment bath. Thus, the electrochemical conditions of the treatment bath can be set to conditions under which the reactions of (1) through (3) do not proceed, in order to prevent the reactions of (1) through (3).

Next, an explanation is provided of the conditions under which the above reactions of (1) through (3) occur in the solution phase, along with their detrimental effects.

(i) Dissociation of Phosphoric Acid

When dissociation of phosphoric acid ($H_3PO_4 \rightarrow H_2PO_4^- \rightarrow PO_4^{3-}$) progresses in the solution phase of the treatment bath, it becomes impossible for phosphate ions to dissolve and exist in the treatment bath, resulting in the formation of sludge ($Zn_2Fe(PO_4)_2$, $M(PO_4)$). The dissociation state of phosphoric acid in a non-electrolytic treatment bath is between $H_3PO_4$ and $H_2PO_4^-$. The degree of dissociation of $H_3PO_4 \rightarrow H_2PO_4^-$ can be expressed as the orthophosphoric acid ratio ($H_3PO_4/H_2PO_4^-$). The following provides an explanation of the relationship between pH and orthophosphoric acid ratio. Although the orthophosphoric acid ratio is 1 when the pH is 0, it is roughly 0.1 at pH 3 (see Ohki, M. and Tanaka, M. ed., Iwanami Koza Publishing, Modern Chemistry 9, Oxidation and Reduction of Acids and Bases, 1979, p. 75). Namely, the orthophosphoric acid ratio ($H_3PO_4/H_2PO_4^-$) decreases from 1 to 0.1 as the pH changes from 0 to 3.

As was previously mentioned, non-electrolytic treatment involves the formation of a film by reacting components in solution. Film formation takes place by dissociating phosphate ion to $PO_4^{3-}$ and reacting with film forming metal ions (e.g., zinc ions). Consequently, in a non-electrolytic treatment bath, the composition consists mainly of $H_2PO_4^-$ to facilitate progression of dissociation of phosphate ions. Consequently, a bath consisting primarily of $H_3PO_4$ at pH 2.5 or lower does not allow the formation of a film in non-electrolytic treatment. For this reason, the pH of a non-electrolytic treatment bath is roughly 3, and $H_3PO_4/H_2PO_4^-$ is controlled in the form of an acid ratio.

The use of a treatment bath roughly at pH 3 for the non-electrolytic treatment bath indicates that there is a possibility of sludge forming easily if electrolytic treatment is simply carried out at that pH.

In the present invention, it is essential to not allow the formation of sludge. In order to not allow sludge to be formed in the treatment bath, it is necessary to control the dissociation state of phosphoric acid with the pH. More specifically, the pH of the electrolytic treatment bath is 2.5 or lower, and more preferably pH 2 or lower.

Although a pH of 0.5 to 5 was used in the prior art (Japanese Unexamined Patent Publication No. 2000-234200), in the present invention, it is preferable that the pH be 2.5 or lower. This is because, if the pH of the treatment bath exceeds 2.5, the ratio of metal ions such as Zn and Mn, which form phosphate compounds by bonding with phosphate ions, to phosphoric acid (ions) becomes relatively large, thereby facilitating the formation of sludge.

(ii) Reaction Accompanying Decrease in Solubility of Fe Ions due to $Fe^{2+} \rightarrow Fe^{3+}$ Fe ions dissolve in the treatment bath when a steel material is used as the article to be treated and when an Fe electrode is used for the film forming metal electrode in electrolytic chemical treatment. The dissolution of Fe proceeds in the manner of $Fe \rightarrow Fe^{2+} \rightarrow Fe^{3+}$, and dissolves and exists in the treatment bath in the state of $Fe^{2+}$ or $Fe^{3+}$.

As the reaction of $Fe^{2+} \rightarrow Fe^{3+} + e^-$ proceeds, the solubility of Fe ions decreases and sludge forms. The reaction of $Fe^{2+} \rightarrow Fe^{3+} + e^-$ of (0.77 V) of formula (3) means that Fe ions can proceed in the dissolved state of $Fe^{2+}$ or $Fe^{3+}$ in solution only when the ORP (oxidation-reduction potential; hydrogen standard electrode potential) of the treatment bath is 0.77 V or higher. If the ORP of the treatment bath is less than 0.77 V, even if Fe ions in solution proceed in the manner of $Fe^{2+} \rightarrow Fe^{3+}$, they are unable to exist in the dissolved state, and oxidized $Fe^{3+}$ solidifies. Namely, sludge forms in the phosphate chemical treatment bath.

In electrolytic phosphate chemical treatment, a voltage of about 10 V or less is preferably applied between the electrodes of the treatment bath. Namely, when anodic electrolysis is carried out using a steel material for the anode, and cathodic electrolysis is carried out using an Fe electrode for the anode and an article to be treated for the cathode, Fe dissolves in the treatment bath ($Fe \rightarrow Fe^{2+} + 2e^-$). In addition, when an article to be treated in the form of a steel material is immersed in a treatment bath at pH 2.5 or lower without applying a voltage, Fe ions dissolve. When a voltage of 10 V or less is applied between the electrodes in the treatment bath, dissolved $Fe^{2+}$ ions are further oxidized. Namely, a state exists in the electrolytic treatment bath in which Fe ions easily proceed in the manner of $Fe^{2+} \rightarrow Fe^{3+}$. At this time, although oxidized Fe ions ($Fe^{3+}$) can be dissolved in the treatment bath if the ORP (oxidation-reduction potential) of the treatment bath is 0.77 V or higher, if the ORP is less than 7.70 mV, the oxidized Fe ions ($Fe^{3+}$) are unable to dissolve and solidify. Namely, sludge forms in the treatment bath. Thus, maintaining the ORP (oxidation-reduction potential) of the treatment bath at 0.77 V or higher is preferable for preventing the formation of sludge and preventing reaction in the solution phase.

Next, is a discussion regarding improving the efficiency of the metal surface (electrode interface) reaction. Table 5 shows the main elementary electrochemical reactions at the electrode interface of electrolytic phosphate chemical treatment (in the case of cathodic treatment). A large change in the potential difference occurs at the electrode interface in electrolytic treatment. Consequently, ions that react at the electrode interface undergo a phase transition reaction accompanying a change in charge. Namely, ions soluble in water become a solid to form a film or become a gas and are removed from the solution at the electrode interface.

TABLE 5

Elementary Electrochemical Reactions at the Electrode Interface (Case of Cathodic Treatment)

| | Anode reactions | Cathode reactions | Others |
|---|---|---|---|
| (i) Metal ion dissolution-precipitation reaction | $Fe \rightarrow Fe^{2+} + 2e^-$ (−0.44 V) (4)<br>$Zn \rightarrow Zn^{2+} + 2e^-$ (−0.77 V) (5)<br>$Ni \rightarrow Ni^{2+} + 2e^-$ (−0.23 V) (6)<br>$Cu \rightarrow Cu^{+} + e^-$ (0.52 V) (7) | $Ni^{2+} + 2e^- \rightarrow Ni$ (−0.23 V) (8)<br>$Cu^{+} + e^- \rightarrow Cu$ (0.52 V) (9)<br>$Fe^{2+} + 2e^- \rightarrow Fe$ (−0.44 V) (10)<br>$Zn^{2+} + 2e^- Zn$ (−0.77 V) (11) | — |
| (ii) Nitrate ion reduction reaction | — | $NO_3^- + 4H^+ + 3e^- \rightarrow NO + 2H_2O$ (0.96 V) (12)<br>$NO_3^- + 2H^+ + e^- \rightarrow 1/2N_2O_4 + H_2O$ (0.8 V) (13) | — |
| (iii) Water decomposition reaction | $2H_2O \rightarrow O_2 + 4H^+ + 4e^-$ (1.23 V) (14) | $2H^+ + 2e^- \rightarrow H_2$ (0 V) (15) | — |
| (iv) Phosphoric acid dissociation and phosphate precipitation | — | — | $H_3PO_4 \rightarrow 3H^+ + PO_4^{3-}$ (16)<br>$2PO_4^{3-} + 2Zn^{2+} + Fe^{2+} \rightarrow Zn_2Fe(PO_4)_2$ (17)<br>$M^{X+}$ (metal ion) + $n(PO_4^{3-}) \rightarrow M(PO_4)$ (18) |

The reactions of Table 5 are classified in the manner shown below.

(i) Dissolution-precipitation reaction of metal ions (ii) Reduction reaction of nitrate ions (iii) Decomposition reaction of solvent (water)

(iv) Dissociation of phosphoric acid and phosphate precipitation reaction

Furthermore, in the case of using an insoluble anode material in cathodic electrolysis, the metal ion dissolution-precipitation reaction of (i) is limited to a precipitation reaction only. Namely, a dissolution reaction does not occur in this case.

The characteristic reactions of electrolytic phosphate chemical treatment consist of the nitrate ion reduction reaction of (ii) and the phosphoric acid dissociation and phosphate precipitation reaction. For this reason, controlling these two reactions at the electrode interface is considered to be an important factor for practical application of electrolytic phosphate chemical treatment.

To begin with, an explanation is provided starting from the nitrate ion reduction reaction. According to Table 5, gas generated in the reduction reaction of nitrate ions is in the form of $N_2O_4$, $NO_2$ or NO. However, as was previously indicated in Table 3, the boiling points of $N_2O_4$ and $NO_2$ are quite different from NO. When considering the ease of removal of these gases from the treatment bath, it is recommended that the gas that is generated be NO because of its low boiling point.

Next, the following is an explanation of a means for obtaining NO as the gas generated in the treatment bath. The respective electrochemical reaction formulas are as follows:

$$NO^{3-}+4H^{+}+3e^{-}\rightarrow NO+2H_2O:0.96\ V \quad (12)$$

$$NO^{3-}+2H^{+}+e^{-}\rightarrow \tfrac{1}{2}N_2O_4+H_2O:0.8\ V \quad (13)$$

The electrochemical reaction formulas of formulas (12) and (13) are intended to show that the ORP (oxidation-reduction potential) of the treatment bath is only equal to or less than the values shown to the right of the formulas, and that the reactions proceed in the directions of the arrows.

Namely, this means that, based on formula (13), although the gas that is generated contains $N_2O_4$ if the ORP of the treatment bath is 0.8 V or lower, if the ORP exceeds 0.8 V, the generated gas can be made to only contain NO. If the generated gas is only NO, then the effect of the generated gas at the electrode surface (interface) is presumed to be made to be of the same level as the conventional electrolytic surface treatment of electroplating. Thus, from the viewpoint of improving efficiency of the interface reactions, it is preferable to make the ORP of the treatment bath greater than 0.8 V.

Next, is an explanation of controlling phosphoric acid dissociation and the phosphate precipitation reaction. As was previously mentioned, it is preferable to maintain the phosphoric acid in solution as $H_3PO_4$ in order to not allow the phosphoric acid to react in the solution phase. In order to accomplish this, the pH is made to be 2.5 or lower. When this is done, phosphoric acid at the electrode interface is dissociated in the manner of $H_3PO_4 \rightarrow PO_4^{3-}$, and a phosphate compound is formed.

The following summarizes a means for solving the problems of the present invention.

The present invention divides the electrolytic phosphate chemical treatment reaction into an electrochemical reaction at the electrode interface and an electrochemical reaction in the solution phase, and then controls each reaction. The present invention is characterized by carrying out the elementary reactions from a solution to a solid (film) only in the form of an electrochemical reaction at the electrode interface. The elementary reactions in which a film is formed from a solution consist of two types of reactions at the cathode interface. These consist of (1) reduction and precipitation reaction of metal ions, and (2) dissociation of phosphoric acid and a precipitation reaction of phosphate crystals. In order to carry out the two types of reactions at the cathode interface only, it is necessary to maintain the solution phase in the state of a solution only. In order to accomplish this, the ORP of the treatment bath is maintained at 700 mV or higher, and preferably 770 mV or higher. Alternatively, in order to more preferably improve reaction efficiency and stabilize the treatment bath, the ORP of the treatment bath is selected to be 800 mV or higher, and more preferably 840 mV or higher. The following is a description of a specific method for maintaining the ORP of the treatment bath at 700 mV or higher. There are two methods for accomplishing this.

(1) Suppressing (controlling) the amount of Fe electrolysis (2) Replenishing and forming Fe-phosphoric acid complex The following is an explanation of these methods.

(1) Suppression (Control) of the Amount of Fe Electrolysis

Fe ions are recognized to be involved in the film formation reaction in the electrolytic phosphate chemical treatment of the present invention. The reasons for Fe ions dissolving in the treatment bath consist of dissolution in the case the article to be treated in anodic treatment is steel, dissolution from the Fe electrode in cathodic treatment, and dissolution from the Fe electrode when treatment is dormant. Control of the amount of Fe electrolysis from the article to be treated and Fe electrode during treatment can be performed by controlling the voltage and current applied. Control of the amounts of this electrolysis can be performed if the amount of electrolysis is roughly 0.1 A/dm$^2$ or less for both anodic and cathodic electrolysis.

In addition, the "dormant electrolysis" described in Japanese Unexamined Patent Publication No. 2000-234200 can be carried out for electrolysis from the Fe electrode while treatment is dormant. Furthermore, dormant electrolysis refers to suppressing the dissolution of Fe while treatment is dormant by using a metal that is insoluble in the treatment bath (such as titanium) for the anode, using an Fe electrode for the cathode, and applying a voltage of 2-5 V.

(2) Replenishment and Formation of Fe-Phosphoric Acid Complex

Replenishment and formation of Fe-phosphoric acid complex involves replenishment of $Fe^{3+}$ ions in the form of a chemical preliminarily in the form of a stable (inactive) complex and not in the form of free (active) ions. The formation of a complex ($Fe^{3+}$–$H_3PO_4$) by $Fe^{3+}$ ions and phosphoric acid is well known. The reactivity of the $Fe^{3+}$ ions decreases if a complex is formed. Namely, if the electrochemical reaction in the solution phase of $Fe^{2+} \rightarrow Fe^{3+} + e^-$ (0.77 V) shown in Table 4 proceeds, since the solubility of Fe ions differs between $Fe^{2+}$ and $Fe^{3+}$, sludge forms if the ORP is lower than 770 mV. The electrochemical reaction of $Fe^{2+} \rightarrow Fe^{3+} + e^-$ (0.77 V) indicates that the reaction can only proceed if the applied voltage is 770 mV or higher in the state in which Fe ions are dissolved.

The addition and dissolution of Fe ions to the treatment bath in the form of a phosphoric acid complex means that the process of $Fe^{2+} \rightarrow Fe^{3+} + e^-$ and its reverse process are omitted simultaneous to free Fe ions ($Fe^{2+}$ or $Fe^{3+}$) being supplied to the treatment bath (solution phase). Consequently, the treatment bath includes a state in which $Fe^{3+}$ dissolved in the form of a complex is in a stable state.

Preparation of a replenishing liquid containing Fe-phosphoric acid complex is carried out by dissolving iron nitrate in a orthophosphoric acid solution. Actual replenishing liquids also contain $Zn^{2+}$, $Ni^{2+}$, $NO_3^-$ and so forth in addition to Fe3+.

(3) Other Treatment

The present invention requires that the ORP of the electrolytic phosphate chemical treatment bath be maintained within a suitable range for film formation. Reactable treatment bath components of the electrolytic phosphate chemical treatment bath decrease accompanying film formation. The decrease in reactable components results in a decrease in reactivity and a decrease in the ORP of the treatment bath. Consequently, ORP is adjusted by replenishing the bath with a chemical containing reactable components. For this reason, the ORP of the treatment bath can be suitably maintained as a general rule by maintaining a balance between the amount of electrolysis for forming a film and the replenishment with chemical. Chemical replenishment of the treatment bath of the present invention is carried out by replenishing a chemical having basically the same chemical components as the treatment bath corresponding to the film that is formed so as to minimize fluctuations in the treatment bath composition according to addition and treatment of the article to be treated.

One of the main factors that has an effect on the ORP of the treatment bath is the pH (hydrogen ion concentration) of the treatment bath. The pH of a typical replenishing chemical is lower than the pH of the treatment bath. Namely, the active hydrogen concentration of the replenishing chemical is greater. Consequently, when replenishing chemical is added, it tends to act in a direction that lowers the pH of the treatment bath, which is turn causes an increase in the ORP of the treatment bath.

Consequently, the concentration of active hydrogen ion contained in the replenishing chemical can also be suppressed in order to suppress an increase in the ORP of the treatment bath. More specifically, the dissociated state of $H_3PO_4$ is controlled even if the composition of $H_3PO_4$ contained in the replenishing chemical is the same. Namely, although orthophosphoric acid exists in the equilibrium state of $H_3PO_4$/$H_2PO_4^-$, that state is shifted to the higher concentration of $H_2PO_4^-$. The addition of such a replenishing chemical makes it possible to control increases in the ORP of the treatment bath.

Continuing, an explanation is provided of the preferable mode for maintaining the ORP of the treatment bath at 840 mV or higher in the present invention. In this mode, the filtration and circulation paths of the treatment bath are basically open, and as a means of separating the $NO_2$, $N_2O_4$ and/or NO gas formed in the treatment bath accompanying electrolytic treatment from the treatment bath, by separating the treatment tank into an electrolytic treatment tank that performs electrolytic treatment and an auxiliary tank that does not perform electrolytic treatment, circulating the treatment bath between the two tanks, and providing a mechanism for exposing the treatment liquid to the atmosphere, $NO_2$, $N_2O_4$ and/or NO gas generated and dissolved in the electrolytic treatment tank is removed. Namely, in this mode, a mechanism is provided that removes nitrogen oxides formed in the treatment bath accompanying electrolytic treatment in a circulation system in which treatment bath subjected to electrolytic treatment in the electrolytic treatment tank returns to said electrolytic treatment tank via a circulation pump and filter. This mechanism is basically a system that opens the filtration and circulation systems of the treatment bath to the atmosphere.

In a system in which the filtration and circulation systems are closed, the treatment bath is in a pressurized state within the system. In the pressurized state, it is difficult for gases dissolved in the treatment bath to escape from solution. If a mechanism is employed that opens the filtration and circulation systems to the atmosphere, namely a mechanism is employed that reduces pressure, dissolved gases can easily escape from solution.

It is preferable to provide a mechanism that is permeable to treatment liquid which allows the passage of membranous and other solid structures in the above auxiliary tank that does not perform electrolytic treatment, and for example, a filter having a mechanism that filters treatment liquid is used as the auxiliary tank.

In particular, a mechanism is provided for the mechanism that facilitates escape of gases that extracts a portion of the treatment liquid prior to being led into a filter cloth or other filtration material and exposes it to the atmosphere in the above filter. The treatment bath is maximally pressurized in front of the filtration material of the filter. Under these maximally pressurized conditions, gases dissolved in the treatment bath are pushed out of solution and aggregated on the cloth. If a portion of the solution under these aggregated conditions is extracted and exposed to the atmosphere, the aggregated gases are rapidly released into the atmosphere.

Furthermore, in the present invention, together with having the function of removing sludge, the filter also has the function of capturing nitrogen oxide gas (NOx) dissolved in the solution. This function consists of precipitating dissolved gas (NOx) onto a filter cloth by This action is for allowing the filter cloth to act catalytically on removal of gas.

In this manner, by making contrivances in the filtration and circulation systems, the elementary reactions of electrolytic phosphate chemical treatment differ. The reactions in which $NO_3^-$ is reduced at the electrode interface are as shown in (12) and (13) of Table 4.

$$NO^{3-}+4H^{+}+3e^{-}\rightarrow NO+2H_2O:0.96\ V \quad (12)$$

$$NO^{3-}+2H^{+}+e^{-}\rightarrow \tfrac{1}{2}N_2O_4+H_2O:0.8\ V \quad (13)$$

Both of these reactions cause the generation of gas from solution (liquid). In addition, when seen from the viewpoint of decomposition of $NO_3^-$, $N_2O_4$ (g) represents the intermediate process of that decomposition, while NO (g) represents the final decomposed form. Namely, decomposition of $NO_3^-$ proceeds in the manner of $NO_3^-\rightarrow N_2O_4$ (g)$\rightarrow$NO (g). This reduction reaction of $NO_3^-$ results in an increase in volume due to this reaction (from a liquid to a gas). According to Le Chatelier's principle, which is one of the basic principles of chemical reactions, in such a reaction system in which a gas is generated and pressure increases, if the reaction system is set in a direction that causes the pressure of the reaction system to decrease, decomposition of $NO_3^-$ easily proceeds in the direction of $NO_3^-\rightarrow N_2O_4$ (g)$\rightarrow$NO (g). Conversely, if the pressure of the reaction system does not decrease, this indicates that there is the possibility of the decomposition of $NO_3^-$ stopping at $NO_3^-\rightarrow N_2O_4$ (g).

Namely, in the case in which the filtration and circulation paths of the treatment bath are basically closed systems, decomposition of $NO_3^-$ has the possibility of stopping at an intermediate point. Indicating this situation in terms of a chemical reaction formula results in formula (13) for the decomposition of $NO_3^-$. This reaction of formula (13) is possible if the ORP of the treatment bath is 800 mv or lower, and consequently, the ORP of the treatment bath is 800 mv or lower.

In contrast, in the case the filtration and circulation paths of the treatment bath are basically an open system, the decomposition reaction of $NO_3^-$ follows formula (12). In the case the ORP of the treatment bath is 960 mV or lower, the reaction can proceed according to formula (12). Thus, according to the principle of electrochemical reactions, in the case the ORP of the treatment bath exceeds 800 mV, the decomposition reaction of $NO_3^-$ only proceeds according to formula (12), and by providing a mechanism for venting gas from the lines, that can be easily achieved. As has been described above, a preferable mode of the present invention can be achieved by making the filtration and circulation system of the treatment bath an open system.

A preferable mode of the present invention provides a mechanism that removes NOx gas generated in the treatment bath accompanying electrolytic treatment in a circulation system in which treatment bath subjected to electrolytic treatment in an electrolytic treatment tank is returned to said electrolytic treatment tank via a circulation pump and filter. The mechanism that removes NOx gas preferably extracts a portion of the treatment liquid prior to being led into the filtering material of the filter, exposes it to the atmosphere and removes NOx gas followed by returning it to said treatment tank by a liquid circulation path. In this case, the ORP of said treatment bath is made to be 800 mV or higher, and preferably 840 mV or higher, and gas formed as a result of decomposition of $NO_3^-$ in the treatment bath is preferably only in the form of NO (g).

Furthermore, the need for maintaining the treatment bath at 840 mV or higher originates in formula (19).

$$NO_3^-2H^{+}+2e^{-}\rightarrow NO_2^-+H_2O\ (0.84\ V) \quad (19)$$

The reaction of formula (19) is a reaction that is not accompanied by a phase transition within the solution phase. The reaction of formula (19) means that, if the ORP of the treatment bath is 840 mV or lower, the possibility exists of $NO_3^-$ in the solution changing to $NO_2^-$. Such a change in the treatment bath is harmful with respect to the stability of the treatment bath. For this reason, maintaining the ORP of the treatment bath above 840 mV is preferable for preventing the reaction of formula (19).

Although the following provides a more detailed explanation of the present invention through its examples, the present invention is not limited to these examples.

Examples 1-3 and Comparative Examples 1-2

The process used in the examples and comparative examples is shown in Table 6. Furthermore, each of the steps of degreasing, rinsing, rinsing, electrolytic phosphate chemical treatment and rinsing are carried out using a tank having a volume of 200 liters. The degreasing step is performed by immersing for 4-5 minutes using an alkaline degreaser at a prescribed concentration and temperature. The rinsing step is carried out until the degreaser and other chemicals are completely removed from the article to be treated. Electrodeposition coating is performed so that the coated film thickness after baking is 15-25 μm, using the Power Top U-56 manufactured by Nippon Paint Co., Ltd.

Figure 3:
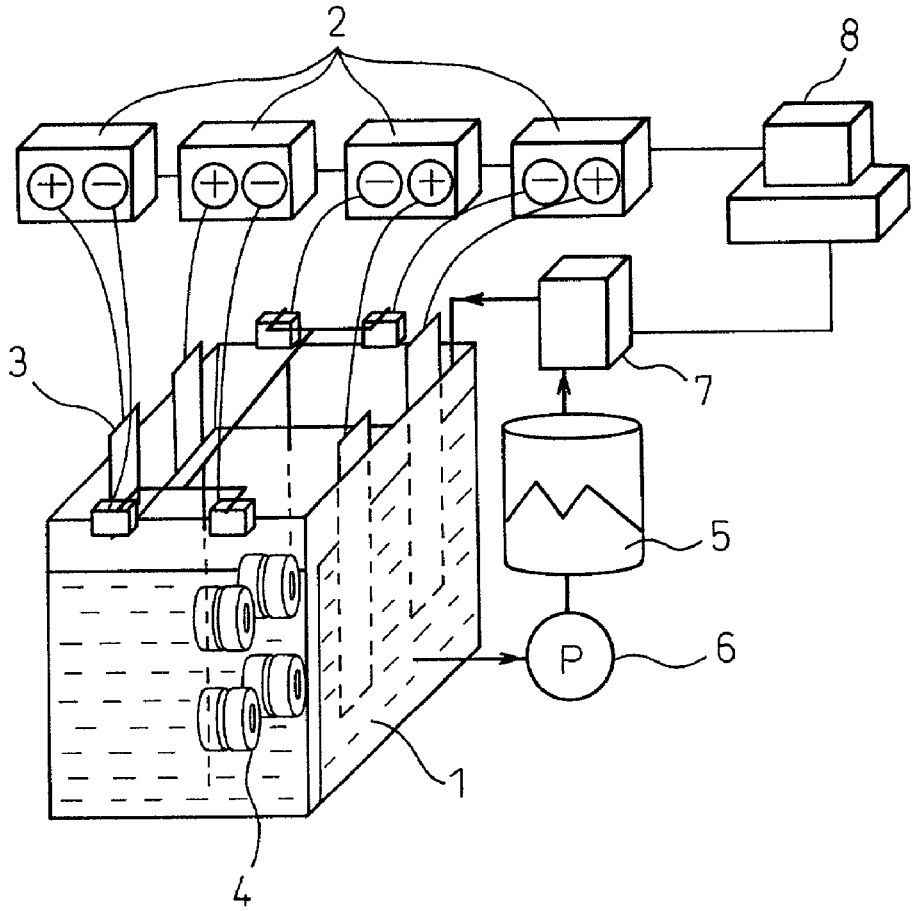
FIG. 3 is a perspective view showing an overview of electrolytic treatment used in the examples and comparative examples.

The volume of the electrolytic treatment bath is 200 liters. The treatment bath was circulated 6-10 times per hour using a filter to ensure the transparency of the treatment bath. In addition, eight sets of automobile air-conditioner parts (clutch, stator housing) used in this experiment per hanger (treatment jig) were treated in the treatment bath. This is depicted in FIG. 3. In FIG. 3, reference symbol 1 indicates a 200 liter treatment bath, 2 a power supply, 3 an electrode, 4 a stator housing (article to be treated), 5 a filter, 6 a pumps, 7 a sensor tank (pH electrode, ORP electrode, etc.) and 8 a controller.

TABLE 6

Process of Examples and Comparative Examples

| Step | De-greasing | Rins-ing | Rinsing | Electro-lytic phos-phate chemical treat-ment | Rinsing | Steps after chemical treat-ment |
|---|---|---|---|---|---|---|
| Examples Compara-tive Examples | ○ | ○ | ○ | ○ | ○ | Pure water rinsing → electro-deposition coating → pure water rinsing → baking (190° C., 25 min.) |

The treatment experiment was performed by immersing the above hangers containing the 8 sets of articles to be treated in the treatment bath about every 2.5 minutes and performing electrolytic phosphate chemical treatment continuously for 4 hours. This results in the treatment of nearly 20 hangers per hour. Furthermore, 2 ml of the chemicals shown in Table 7 were added to the electrolytic reaction system of FIG. 3 for each example and comparative example after the initial treatment and after each treatment of a single hanger.

TABLE 7

Composition of Replenishing Chemicals (g/Kg, remainder: water)

| | Example 1 | Example 2 | Example 3 | Comp. Ex. 1 | Comp. Ex. 2 |
|---|---|---|---|---|---|
| 75% $H_3PO_4$ | 52 | 52 | 100 | 52 | 110 |
| $Ni(NO_3)_2 \cdot 6H_2O$ | 400 | 400 | 400 | 628 | 628 |
| $Zn(NO_3)_2 \cdot 6H_2O$ | 200 | 100 | 100 | 200 | 0 |
| ZnO | 0 | 0 | 25 | 0 | 26 |
| $Fe(NO_3)_3 \cdot 9H_2O$ | 0 | 72 | 0 | 0 | 0 |

Figure 4:
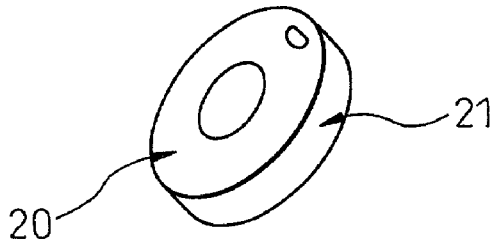
FIG. 4 is a perspective view of an article to be treated in the form of a stator housing used in the examples and comparative examples.

The automobile air-conditioner part (clutch, stator housing) shown in FIG. 4 was used as the article to be treated in the examples and comparative examples. The stator housing of FIG. 4 consists of welding and joining a plate 20 (press stamped part) that serves as a flat surface, and a housing that serves as outer peripheral portion 21 (press formed part). The housing serving as the outer peripheral portion is made by deforming a flat plate to an irregular structure by press forming. For this reason, the outer peripheral portion is a surface that is greatly deformed in press forming. Lubricating oil strongly adheres to the greatly deformed surface during press forming. This strongly adhered lubricating oil inhibits the phosphate chemical treatment reaction. Therefore, this causes a decrease in the performance of the treated surface (corrosion resistance of the coating). Thus, the outer peripheral portion shown in FIG. 4 decreases in corrosion resistance of the coating by non-electrolytic treatment when phosphate chemical treatment is performed. This is explained in Japanese Unexamined Patent Publication No. 2000-234200 of the prior art. Electrolytic phosphate chemical treatment is performed in both the examples and comparative examples of the invention. The resistance to corrosion of the coating is favorable in all cases.

[Electrolytic Phosphate Chemical Treatment Method]

Figure 5:
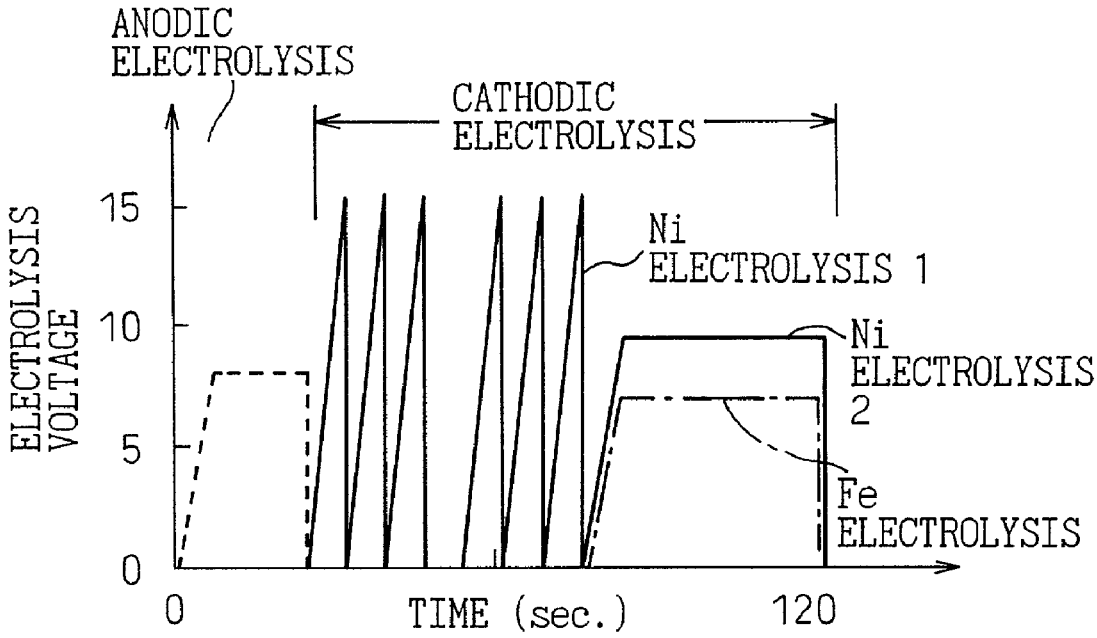
FIG. 5 is a graph showing the schedule of electrolytic treatment carried out in the examples and comparative examples.

Electrolytic phosphate chemical treatment was carried out with the electrolysis method shown in FIG. 5.

The treatment time of electrolytic phosphate chemical treatment was 120 seconds. The reason for performing one round of treatment every 2.5 minutes was because about 30 seconds were required for movement of the hanger and so forth. Electrolytic treatment consisted of cathodic electrolysis and anodic electrolysis. Cathodic electrolysis consisted of initially performing 13 rounds of pulsed electrolysis using an Ni electrode and subsequently performing continuous electrolysis using an Ni electrode and Fe electrode. Details of the electrolysis conditions in the examples and comparative examples are shown in the following table (Table 8). Furthermore, the amount of Fe electrolysis shown in Table 8 is the amount of Fe electrolysis when the effective surface area of the article to be treated is 2 $dm^2$/piece.

TABLE 8

| Electro-lysis conditions (per 8 hous-ings) | Anodic electrolysis | Cathodic electrolysis Fe | Cathodic electrolysis Ni |
|---|---|---|---|
| Ex. 1 | 10 V × 0.6 A × rising for 1 sec., holding for 21 sec. (Amt. of Fe electrolysis: 0.04 A/$dm^2$) | Dormant for 42 sec., 10 V × 0.6 A × rising for 20 sec., holding for 35 sec. (Amt. of Fe electrolysis: 0.04 A/$dm^2$) | 1.12 V × 30 A (dormant for 1 sec., rising for 2 sec.) × 13 times 2.10 V × 20 A, rising for 15 sec., holding for 43 sec. |
| Ex. 2 | 8 V × 0.1 A × rising for 2 sec., holding for 6 sec. (Amt. of Fe electrolysis: 0.0 A/$dm^2$) | Dormant for 42 sec., 10 V × 0.0 A × rising for 20 sec., holding for 50 sec. (Amt. of Fe electrolysis: 0.0 A/$dm^2$) | 1.23 V × 60 A (dormant for 1 sec., rising for 2 sec.) × 13 times 2.20 V × 53 A, rising for 15 sec., holding for 58 sec. |
| Ex. 3 | 8 V × 0.2 A × rising for 1 sec., holding for 21 sec. (Amt. of Fe electrolysis: 0.01 A/$dm^2$) | Dormant for 42 sec., 8 V × 0.1 A × rising for 20 sec., holding for 35 sec. (Amt. of Fe electrolysis: 0.01 A/$dm^2$) | 1.10 V × 20 A (dormant for 1 sec., rising for 2 sec.) × 13 times 2.10 V × 17 A, rising for 15 sec., holding for 43 sec. |
| Comp. Ex. 1 | 8 V × 5.1 A × rising for 2 sec., holding for 6 sec. (Amt. of Fe electrolysis: 0.34 A/$dm^2$) | Dormant for 42 sec., 18 V × 2.4 A × rising for 20 sec., holding for 50 sec. (Amt. of Fe electrolysis: 0.15 A/$dm^2$) | 1.24 V × 60 A (dormant for 1 sec., rising for 2 sec.) × 13 times 2.18 V × 37 A, rising for 15 sec., holding for 58 sec. |
| Comp. Ex. 2 | 8 V × 2.4 A × rising for 2 sec., holding for 6 sec. (Amt. of Fe electrolysis: 0.15 A/$dm^2$) | Dormant for 42 sec., 16 V × 1.1 A × rising for 20 sec., holding for 50 sec. (Amt. of Fe electrolysis: 0.07 A/$dm^2$) | 1.18 V × 45 A (dormant for 1 sec., rising for 2 sec.) × 13 times 2.16 V × 32 A, rising for 15 sec., holding for 58 sec. |

[Experiment Results]

(1) Fluctuations in Treatment Bath Composition and Electrochemical Conditions

The results of treatment bath composition, chemical analysis values and electrochemical conditions accompanying continuous electrolytic treatment are shown in Table 9.

Furthermore, the values indicated for ORP in Table 9 are shown based on an Ag/AgCl electrode serving as the ORP electrode used in the experiment apparatus. The values indicated with the Ag/AgCl electrode can be converted to potential values based on the hydrogen standard electrode potential serving as the indicated value present invention by adding 210 mV to those values.

TABLE 9

| | | Treatment bath composition (g/L) | | | | Chem. anal. value | Treatment bath electrochemical conditions | | |
|---|---|---|---|---|---|---|---|---|---|
| | Treatment times | Phosphate ion | Nitrate ion | Nickel ion | Zinc ion | Total acidity (Pt) | pH | ORP Ag/AgCl electrode potential | Temp. (° C.) |
| Ex. 1 | 0 | 3.3 | 21.7 | 7.3 | 3.5 | 28 | 1.53 | 616 | 30.6 |
| | 20 | 3.3 | 21.7 | 7.2 | 3.5 | 28 | 1.52 | 597 | 30.9 |
| | 40 | 3.3 | 21.7 | 7.3 | 3.5 | 28 | 1.52 | 607 | 31 |
| | 60 | 3.3 | 21.7 | 7.3 | 3.5 | 28 | 1.51 | 607 | 31 |
| | 80 | 3.3 | 21.7 | 7.3 | 3.5 | 28 | 1.5 | 600 | 31 |
| Ex. 2 | 0 | 3.2 | 11.7 | 5.1 | 0.6 | 18 | 1.6 | 625 | 30.1 |
| | 20 | 3.2 | 11.7 | 5.1 | 0.6 | 17 | 1.61 | 581 | 31.6 |
| | 40 | 3.2 | 11.7 | 5.1 | 0.6 | 17 | 1.6 | 563 | 31.9 |
| | 60 | 3.2 | 11.7 | 5.1 | 0.6 | 17 | 1.62 | 554 | 31.6 |
| | 80 | 3.2 | 11.7 | 5.1 | 0.6 | 18 | 1.62 | 584 | 31 |
| Ex. 3 | 0 | 4.8 | 16.6 | 4.6 | 3.5 | 25 | 1.62 | 627 | 28.9 |
| | 20 | 4.8 | 16.5 | 4.6 | 3.4 | 25 | 1.61 | 603 | 29 |
| | 40 | 4.8 | 16.4 | 4.7 | 3.4 | 25 | 1.6 | 586 | 29.2 |
| | 60 | 4.8 | 16.4 | 4.6 | 3.3 | 25 | 1.7 | 531 | 32.5 |
| | 80 | 4.8 | 16.2 | 4.6 | 3.3 | 25 | 1.69 | 563 | 32.7 |
| Comp. Ex. 1 | 0 | 3.6 | 14 | 6.8 | 1.6 | 26 | 2.82 | 256 | 27.7 |
| | 20 | 3.6 | 14.1 | 6.8 | 1.6 | 24 | 2.31 | 261 | 31.4 |
| | 40 | 3.6 | 14.1 | 6.8 | 1.6 | 25 | 1.98 | 251 | 30 |
| | 60 | 3.6 | 14 | 6.8 | 1.6 | 25 | 2.02 | 258 | 29.6 |
| | 80 | 3.6 | 14 | 6.8 | 1.6 | 25 | 1.92 | 267 | 31.9 |
| Comp. Ex. 2 | 0 | 4.2 | 11.6 | 4.7 | 1.4 | 21 | 2.02 | 263 | 29.6 |
| | 20 | 4.2 | 11.5 | 4.7 | 1.4 | 21 | 1.63 | 264 | 31 |
| | 40 | 4.2 | 11.2 | 4.7 | 1.4 | 21 | 1.64 | 263 | 29.5 |
| | 60 | 4.2 | 11.2 | 4.7 | 1.4 | 21 | 1.62 | 267 | 30.9 |
| | 80 | 4.2 | 11.8 | 4.7 | 1.4 | 21 | 1.62 | 268 | 30 |

(2) Evaluation of Coating Corrosion Resistance

The article to be treated was subjected to electrodeposition coating in the steps following the chemical treatment of Table 6. Following electrodeposition coating, a coating corrosion resistance evaluation test was performed on the article to be treated. The coating corrosion resistance evaluation test was performed by making scratches in the coating extending to the substrate with a knife in the flat surface portion and outer peripheral portion of the article to be treated, and immersing it for 240 hours in a 5% sodium chloride solution at 55° C. After 240 hours of immersion had elapsed, the article to be treated was rinsed with water and dried by allowing it to stand for at least 2 hours, followed by affixing adhesive tape to the coated surface that was scratched with the knife and then peeling off the tape with considerable force. The width of the coating film that was peeled off as a result of peeling off the tape was measured and used to evaluate coating corrosion resistance. The smaller the peeled width, the better the corrosion resistance. The results of evaluation of coating corrosion resistance are shown in Table 10 for both the examples and comparative examples.

TABLE 10

| Results of Evaluation of Coating Corrosion Resistance (peeled width after salt water immersion test, max. value (mm)) | | | | | |
|---|---|---|---|---|---|
| | Example 1 | Example 2 | Example 3 | Comp. Ex. 1 | Comp. Ex. 2 |
| Flat surface portion | 0 | 0 | 0 | 1 | 0 |

TABLE 10-continued

| Results of Evaluation of Coating Corrosion Resistance (peeled width after salt water immersion test, max. value (mm)) | | | | | |
|---|---|---|---|---|---|
| | Example 1 | Example 2 | Example 3 | Comp. Ex. 1 | Comp. Ex. 2 |
| Outer peripheral portion | 0 | 1 | 0 | 2 | 0 |

(3) Stability of Treatment Bath

The stability of the treatment bath (presence of sludge formation) is shown in Table 11. As indicated in Japanese Unexamined Patent Publication No. 2000-234200 of the prior art, it is essential in electrolytic phosphate chemical treatment that the treatment bath be transparent during treatment. The formation of sludge was not observed in the treatment bath during treatment for any of the examples and comparative examples. Thus, coating corrosion resistance was also satisfactory. However, when the treatment bath was allowed to stand for 3 days following completion of continuous treatment, sludge formed in the treatment baths of the comparative examples. There was no formation of sludge in the treatment baths of the examples. The treatment baths of the comparative examples both had an ORP of about 260 mV (Ag/AgCl electrode), and this is equivalent to a potential based on the hydrogen standard potential of about 470 mV, which does not fall within the present invention.

TABLE 11

| | Example 1 | Example 2 | Example 3 | Comp. Ex. 1 | Comp. Ex. 2 |
|---|---|---|---|---|---|
| During treatment | None | None | None | None | None |
| 3 days after treatment | None | None | None | Formed | Formed |

Explanation of Examples 1-3 and Comparative Examples 1-2 and Analysis of Experiment Results Example 1

Example 1 is the standard method of the present invention. The amount of Fe electrolysis is controlled and the standard chemical is used. For this reason, there is no formation of sludge in the treatment bath even after standing.

Example 2

Example 2 is an example of the present invention in the case of using a replenishing chemical containing Fe ions.

Example 3

Example 3 is an example of the present invention showing the use of a chemical in which the degree of dissociation of phosphoric acid has been adjusted for the replenishing chemical in order to lower the ORP of the treatment bath. Furthermore, the same chemical as in Example 1 is used starting in the 61$^{st}$ round of treatment in Example 3. This is done for the purpose of raising the ORP again after it has lowered.

Comparative Example 1

Comparative Example 1 is an example of an increased amount of Fe electrolysis and a lowered ORP of the treatment bath. The amount of Fe electrolysis is 0.15 A/dm$^2$, which is larger than that of the examples.

Comparative Example 2

In comparative example 2, although the amount of Fe electrolysis is large at 0.15 A/dm$^2$ with respect to anodic electrolysis, that with respect to cathodic electrolysis is suitable at 0.07 A/dm$^2$. In this example, however, the chemical used for the replenishing chemical in which the degree of dissociation of phosphoric acid is adjusted is the same as that used in Example 3. When the use of a chemical in which the degree of dissociation of phosphoric acid is adjusted is continued, the ORP of the treatment bath lowers.

Examples 4 and 5

Figure 6:
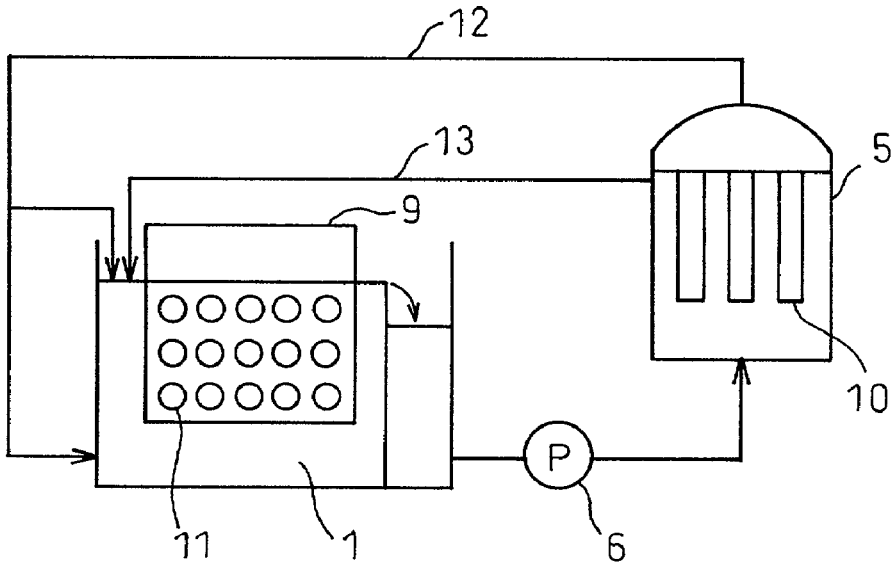
FIG. 6 is a block drawing of open system lines showing a first mode for carrying out the present invention.
Figure 7:
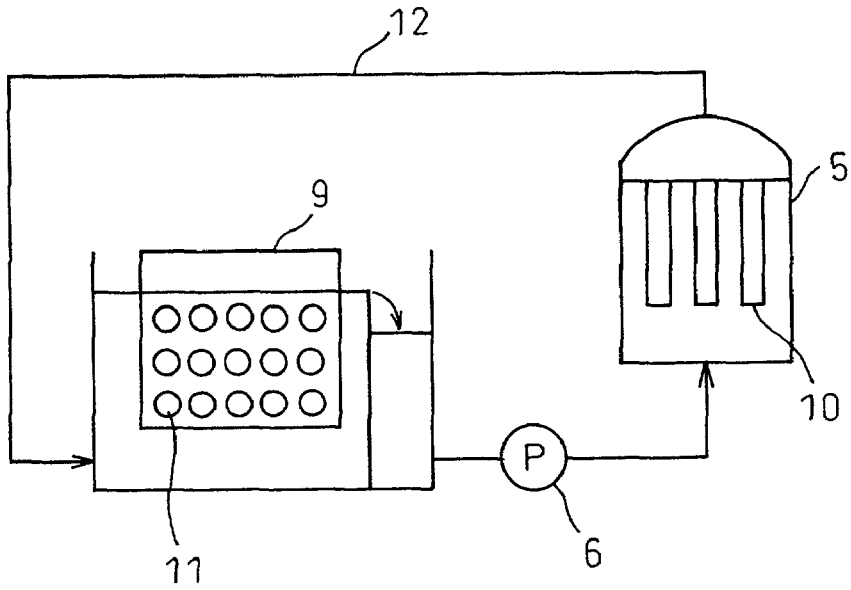
FIG. 7 is a block drawing of closed system lines showing a first mode for carrying out the present invention.

These examples are examples of mass production equipment that form a filtration and circulation circuit in which the tank volume is 1000 liters, the filter volume 400 liters and the total volume of the treatment bath, including the volume of the sensor tank and so forth, is 1500 liters. The filtration and circulation path is an open system composed with lines as shown in FIG. 6 (Example 4) or a closed system composed with lines as shown in FIG. 7 (Example 5). In FIGS. 6 and 7, reference symbol 9 indicates a hanger, 10 a filter cloth, and 11 an article to be treated. In the open system of FIG. 6, in addition to main circulation line 12, pressure reducing open line 13 is also provided. Gas dissolved in the solution is discharged from this pressure reducing open line 13. These steps are basically as described in Table 6 (with the exception of two degreasing steps), and each step is carried out by a series of equipment in a tank having a volume of 1000 liters. In each step, the article to be treated is immersed for 110 seconds and then moved to the next step in 40 seconds. An alkaline degreaser at a prescribed concentration and temperature is used in the degreasing steps. The electrolytic treatment bath is circulated 3-12 times per hour with a filtration circulation pump. The treatment hanger is used during treatment by attaching 30 automobile air-conditioner parts in the form of the article to be treated shown in FIG. 4 per side, or 60 parts on both sides, to each hanger. Electrodeposition coating is performed so that the coated film thickness after baking is 15-25 μm, using the Power Top U-56 manufactured by Nippon Paint Co., Ltd.

Although the basic constitution of the electrolytic phosphate chemical treatment apparatus is as shown in FIG. 3, the volume is changed as previously described. Eight Ni electrodes and two Fe electrodes are provided for film forming electrodes. Four Ni electrodes each are installed on both sides of the hanger so that current flows uniformly to the article to be treated. In addition, one Fe electrode each in the form of an iron core having a diameter of 10 mm is installed on both sides of the hanger. The treatment bath was made to be able to circulate through the treatment tank 3-12 times per hour via the filter. In addition, the chemicals shown in Table 12 were added to the electrolytic treatment reaction bath at 62 mL/hanger in Example 4 and 30 mL/hanger in Example 5 for each hanger treated.

TABLE 12

| | Example 4 | Example 5 |
|---|---|---|
| $H_3PO_4$ | 85 g/L | 115 g/L |
| $NO_3$ | 296 g/L | 270 g/L |
| Ni | 80 g/L | 50 g/L |
| Zn | 68 g/L | 85 g/L |

Electrolytic phosphate chemical treatment was carried out according to the method of FIG. 5. This treatment was performed for 110 seconds/cycle-hanger, after which the hanger was moved to the next tank in 40 seconds. Thus, treatment for 110 seconds was repeated every 150 seconds. Electrolytic treatment was carried out in the order of anodic electrolysis followed by cathodic electrolysis. Cathodic electrolysis consisted of initially performing 8 rounds of pulsed electrolysis using an Ni electrode and subsequently performing continuous electrolysis using an Ni electrode and Fe electrode. The details of these electrolysis conditions are shown in Table 13.

TABLE 13

| Electrolysis conditions (per 60 work pieces) | Anodic electrolysis | Cathodic electrolysis Fe | Cathodic electrolysis Ni |
|---|---|---|---|
| Examples 4 and 5 | 5 V × 0.1 A × rising for 1 sec., holding for 8 sec. | Dormant for 42 sec., 4 V × 0.1 A × rising for 20 sec., holding for 35 sec. | (1) 8.5 V × 200 A (dormant for 1 sec., rising for 2 sec.) × 8 times (2) 8.5 V × 200 A, rising for 15 sec., holding for 43 sec. |

[Experiment Results]

(1) Treatment Bath Composition and Electrochemical Conditions

The mean results of treatment bath composition, chemical analysis values and electrochemical conditions in the case of continuous electrolytic treatment with mass production equipment are shown in Table 14.

Furthermore, the values indicated for ORP in Table 14 are shown based on an Ag/AgCl electrode serving as the ORP electrode used in the experiment apparatus. The values indicated with the Ag/AgCl electrode can be converted to potential values based on the hydrogen standard electrode potential serving as the indicated value of the present invention by adding 210 mv to those values.

TABLE 14

Status of Phosphate Chemical Treatment Bath (Mean Values)

| | Treatment bath composition (g/L) | | | | Chem. anal. Values Total acidity (Pt) | Treatment bath electrochemical conditions | | |
|---|---|---|---|---|---|---|---|---|
| | Phosphate ion | Nitrate ion | Nickel ion | Zinc ion | | pH | ORP Ag/AgCl electrode potential | Temp. (° C.) |
| Ex. 4 | 12.2 | 46 | 17.1 | 14.1 | 86 | 1.23 | 674 | 30 |
| Ex. 5 | 7.69 | 31.5 | 12 | 8.99 | 54 | 2.48 | 597 | 33 |

In Example 5, the pH was higher, ORP was lower and concentrations of treatment bath components were lower than in Example 4. This indicates that the filtration-circulation system is a closed system, and that the electrochemical reaction efficiency is inferior to an open system. The ORP of 597 mV indicates the possibility of the occurrence of the reaction of formula (19), which is one of the reactions in the solution phase (solution reaction) in the treatment bath. The potential based on the Ag/AgCl electrode of the reaction of formula (19) is 630 mV or less.

$$NO_3^- + 2H^+ + 2e^- \rightarrow NO_2^- + H_2O \ (0.84\ V) \quad (19)$$

If the reaction of formula (19) actually occurred, the components in solution would react and the solution state would tend to break down. Consequently, a solution state would result that facilitated the formation of sludge, the stability of the treatment bath as a solution would decrease, and the both allowed to stand would form sludge easily. In actuality, sludge formed when the bath was allowed to stand for 3 days. On the basis of this, making the filtration-circulation circuit of the treatment bath an open system and removing NOx that forms sludge were confirmed to be preferable for the stability of the treatment bath.

(2) Evaluation of Coating Corrosion Resistance

The article to be treated was subjected to electrodeposition coating in the steps following the chemical treatment previously described. Following electrodeposition coating, a coating corrosion resistance evaluation test was performed on the article to be treated. The coating corrosion resistance evaluation test was performed in the same manner as the test method in Examples 1-3. The results are shown in Table 15.

TABLE 15

| | Example 4 | Example 5 |
|---|---|---|
| Flat surface portion | 0 | 0 |
| Outer peripheral portion | 1 | 1 |

(3) Evaluation of Coating Adhesion

Following electrodeposition coating, a coating adhesion evaluation test was performed on the article to be treated. Evaluation of coating adhesion was performed according to the cross-cut adhesion method of JIS-K 5400 8.5.1 using a gap interval between cuts of 1 mm or 2 mm. Cuts were made in the flat surface portion at a gap interval of 1 mm, while cuts were made in the inner peripheral portion at a gap interval of 2 mm. The reason for using a gap interval of 2 mm for the cuts made in the inner peripheral portion was because current flows easier through the inside of the work piece (inner peripheral portion) than through the outside (flat surface portion), and it was difficult to make cuts at a gap interval of 1 mm. Those results are shown in Table 16.

TABLE 16

| | Example 4 | Example 5 |
|---|---|---|
| Flat surface portion | 0% | 0% |
| Inner peripheral portion | 0% | 10% |

(4) Stability of Treatment Bath

The stability of the treatment bath is shown in Table 17. The formation of sludge was not observed in the treatment bath during treatment in Example 4 or 5. However, as was previously mentioned, when the treatment bath was allowed to stand for 3 days following completion of continuous treatment, sludge formed in the treatment bath of Example 5. There was no formation of sludge in the treatment bath of Example 4. The treatment bath of Example 5 had an ORP of 597 mV (Ag/AgCl electrode), and although this is equivalent to a potential based on the hydrogen standard potential of about 807 mV, since there was no removal of NOx in this case, Example 4, which was accompanied by NOx removal treatment, was indicated as being preferable.

TABLE 17

| | Example 4 | Example 5 |
|---|---|---|
| During treatment | None | None |
| 3 days after treatment | None | Formed |

Explanation of Examples 4 and 5 and Analysis of Experiment Results

Examples 4 and 5 are examples of practical mass production systems. When applied to mass production equipment, it was confirmed that it is preferable to make different accommodations than those of Examples 1-3 using experimental systems. Namely, since the treatment volume is continuous and large, the removal of NOx gas, which was able to be ignored in the experimental systems, is important. The difference between Examples 4 and 5 is the presence or absence of removal of NOx gas. This difference between the two was manifest in their respective treatment baths. Namely, if NOx gas is not removed, the concentration of NOx gas in the treatment bath does not decrease, and this acts in the direction of inhibiting the reduction reaction of $NO_3^-$, with the reaction of formula (19) coming to act as the solution reaction.

$$NO_3^- + 2H^+ + 2e^- \rightarrow NO_2^- + H_2O \ (0.84\ V) \quad (19)$$

Consequently, the electrolysis reaction efficiency in the treatment bath decreases. As a result, since chemical components are not consumed, the component concentration of the treatment bath increases, the stability of the treatment bath as a solution decreases, and susceptibility to sludge formation increases. Moreover, if the electrolysis reaction efficiency decreases, the adhesion of the coating film as well as coating corrosion resistance also decrease. Therefore, removal of NOx gas was found to be preferable particularly in cases in which the treatment volume is not small, but rather large and continuous.

According to the present invention, the following effects are demonstrated.

(1) Substantial Elimination of Sludge Formation in the Treatment Bath

The present invention was shown in principle to be able to substantially eliminate sludge. However, in the case of actual mass production equipment, variations exist in the contents of the treatment bath. In order to reduce variations in the reactions and treatment bath, the ORP in the treatment bath should be raised and maintained at 840 mV or higher. If this is done, sludge formation can be substantially reduced to zero, with the exception of minor variations.

(2) Improvement of Chemical Film Quality

In the present invention, the electrochemical reactions accompanying phase transitions relating to film formation can be limited to only electrochemical reactions at the electrode interface by substantially eliminating sludge formation. In addition, the decomposition reaction of $N_3^-$ at the electrode interface can be made to consist only of formula (12), thereby making it possible to improve electrolysis reaction efficiency. Consequently, the film that is formed can be formed reliably adhered to the article to be treated. For this reason, in the case of a coating substrate, a film can be formed having a coating corrosion resistance superior to cases in which sludge is formed.

What is claimed is:

1. An electrolytic phosphate chemical treatment method of forming a film composed of a phosphate compound and a metal that is reduced and precipitated from an ionic state on the surface of a metal material article to be treated, comprising:

performing the electrolytic phosphate chemical treatment on said metal material article in a phosphate chemical treatment bath by contacting said metal material article with said phosphate chemical treatment bath containing phosphate ions, phosphoric acid, nitrate ions, metal ions that form a complex with the phosphate ions and phosphoric acid in said phosphate chemical treatment bath, and metal ions, wherein a dissolution-precipitation equilibrium potential at which the metal ions in said phosphate chemical treatment bath are reduced and precipitate as the metal is equal to or greater than −830 mV, which is the cathodic reaction decomposition potential of water when indicated as a hydrogen standard electrode potential, wherein the electrolytic phosphate chemical treatment involves the application of voltage and current from an external power supply, and cathodic electrolysis is carried out using the metal material article for the cathode;

the phosphate chemical treatment bath has a pH of 2.5 or lower and is substantially free of metal ions, other than those which are a component of the film, which will form sludge;

Fe is present and an amount of Fe ions dissolved in the phosphate chemical treatment bath is controlled by changes in the amount of Fe ions dissolved into the phosphate chemical treatment bath from a Fe ion source, the Fe ion source being at least one of (1) an electrode when said electrode comprises Fe, (2) a replenishing liquid containing Fe ions and (3) the metal material article to be treated when the metal article to be treated comprises a steel material, so that the phosphate chemical treatment bath does not contain $Fe^{3+}$ ions in an amount of more than the solubility limit;

$NO_2$ and/or $N_2O_4$ gas generated and dissolved in the phosphate chemical treatment bath during a reduction reaction of the nitrate ions of the electrolytic treatment is removed from the treatment bath by separating a treatment tank into an electrolytic treatment tank where the electrolytic treatment is carried out and an auxiliary tank where no electrolytic treatment is carried out, circulating the treatment bath between the two tanks, and providing a mechanism that opens the treatment bath to the atmosphere at a reduced pressure either between the two tanks or within the two tanks, as a means of separating the $NO_2$ and/or $N_2O_4$ gas from the treatment bath; and the oxidation-reduction potential (ORP) of said phosphate chemical treatment bath, indicated as the potential relative to the hydrogen standard electrode potential, is maintained at 770 mV to 960 mV, and is used to monitor the phosphate chemical treatment bath.

2. The electrolytic phosphate chemical treatment method according to claim 1, wherein said electrolytic treatment uses for an electrode material that dissolves in the phosphate chemical treatment bath the metal ions that form a complex with the phosphoric acid and the phosphate ions in the phosphate chemical treatment bath, a metal material wherein a dissolution-precipitation equilibrium potential at which the metal ions in the phosphate chemical treatment bath from the metal material are reduced and precipitate as the metal is greater than or equal to −830 mV, or a metal material that is insoluble during the electrolytic treatment.

3. The electrolytic phosphate chemical treatment method according claim 1, wherein the amount of Fe ions dissolved into the phosphate chemical treatment bath provides that said ORP of the phosphate chemical treatment bath is 800 mV to 960 mV and maintains the amount of Fe ions within the solubility limit of $Fe^{3+}$ ions.

4. The electrolytic phosphate chemical treatment method according to claim 1, wherein the amount of Fe ions dissolved into the phosphate chemical treatment bath provides that said ORP of the phosphate chemical treatment bath is 770 mV to 960 mV.

5. The electrolytic phosphate chemical treatment method according to claim 1, comprising a second electrode used in the electrolytic treatment for making the ORP of the phosphate chemical treatment bath 770 mV to 960 mV, and wherein said second electrode is an insoluble metal material.

6. The electrolytic phosphate chemical treatment method according to claim 1, wherein the metal ions that form a complex with the phosphate ions and phosphoric acid in the phosphate chemical treatment bath are at least one of Zn, Fe, or Mn ions.

7. The electrolytic phosphate chemical treatment method according to claim 1, wherein the auxiliary tank that does not carry out the electrolytic treatment has a mechanism in which the treatment liquid is passed through a permeable solid structure.

8. The electrolytic phosphate chemical treatment method according to claim 7, wherein the solid structure is a film.

9. The electrolytic phosphate chemical treatment method according to claim 1, wherein a filter having a mechanism that filters the treatment liquid is used for the auxiliary tank that does not carry out the electrolytic treatment.

10. The electrolytic phosphate chemical treatment method according to claim 1, wherein the circulating comprises removing, through a liquid circulation circuit, a portion of the treatment bath at a location prior to being introduced into a filter material in a filter, wherein the auxiliary tank includes the filter material of the filter and the removed portion of the treatment bath is fed to the filter material of the filter via the liquid circulation circuit, and wherein the removed portion of the treatment bath is returned to the electrolytic treatment tank after separating the $NO_2$ and $N_2O_4$ present in the removed portion of the treatment bath.

11. The electrolytic phosphate chemical treatment method according to claim 1, wherein the treatment bath is maintained in a constant state by measuring an oxidation-reduction potential value of the treatment bath and changing an amount and/or composition of replenishing chemical corresponding to the change in that value.

12. The electrolytic phosphate chemical treatment method according to claim 1, wherein the ORP of said phosphate chemical treatment bath is maintained at 800 mV to 960 mV.

13. The electrolytic phosphate chemical treatment method according to claim 1, wherein when using the Fe electrode in the cathodic electrolysis, the cathodic electrolysis is controlled by controlling the amount of $Fe^{2+}$ ions dissolved into the phosphate chemical treatment bath from said Fe electrode ($Fe \rightarrow Fe^{2+} + 2e^-$) so that the phosphate chemical treatment bath does not contain $Fe^{3+}$ ions more than the solubility limit when said $Fe^{2+}$ ions are oxidized to $Fe^{3+}$ ions ($Fe^{2+} Fe^{3+} + e^-$).

* * * * *